US005941578A

United States Patent [19]

Shamblin

[11] Patent Number: 5,941,578

[45] **Date of Patent: *Aug. 24, 1999**

[54] IMPACT RESISTANT SAFETY DOOR LATCH MECHANISM

[76] Inventor: Rosco Shamblin, 4654 Loganway, Hubbard, Ohio 44425

[ * ] Notice: This patent is subject to a terminal disclaimer.

[21] Appl. No.: 08/908,254

[22] Filed: Aug. 7, 1997

[51] Int. Cl.[6] ..... E05C 1/06

[52] U.S. Cl. ..... 292/144; 292/251.5; 292/341.12; 292/DIG. 23; 292/DIG. 73

[58] Field of Search ..... 292/144, 145, 292/251.5, DIG. 23, DIG. 25, 55, 340, 341.18, DIG. 55, DIG. 56, DIG. 73, 163, 341.12, 341.13

[56] References Cited

U.S. PATENT DOCUMENTS

| | | | |
|---|---|---|---|
| 1,947,524 | 2/1934 | Horldt | 16/85 |
| 2,547,108 | 4/1951 | Anderson | 292/170 |
| 3,309,664 | 3/1967 | Deutsch et al. | 340/56 |
| 4,372,419 | 2/1983 | Barnett et al. | 180/289 |
| 5,386,713 | 2/1995 | Wilson | 70/280 |
| 5,531,086 | 7/1996 | Bryant | 70/279 |
| 5,546,777 | 8/1996 | Liu et al. | 70/257 |
| 5,572,098 | 11/1996 | Dreon et al. | 318/293 |
| 5,593,191 | 1/1997 | DeMarco | 292/144 |
| 5,655,800 | 8/1997 | DeMarco | 292/167 |
| 5,715,712 | 2/1998 | West | 70/257 |

*Primary Examiner*—Steven Meyers
*Assistant Examiner*—Clifford B Vaterlaus
*Attorney, Agent, or Firm*—Robert G. Lev

[57] ABSTRACT

A security door latching mechanism and complementary receiver are arranged to be installed within a door and a complementary doorjamb. In the preferred embodiment, the installation takes place in a vehicle and the latching mechanism can be installed either in the door or in the door frame or jamb. The latching mechanism includes a plunger shaft which is arranged to extend from the doorjamb into the receiver, and is forcibly maintained in the extended position until retracted by an electrical current provided to an actuator. This actuator is spring-driven to keep the plunger shaft in an extended position until provided with an electrical power to retract the plunger shaft. It is necessary to constantly maintain the electric power to the actuator in order to keep the plunger shaft retracted.

17 Claims, 2 Drawing Sheets

FIG. 1
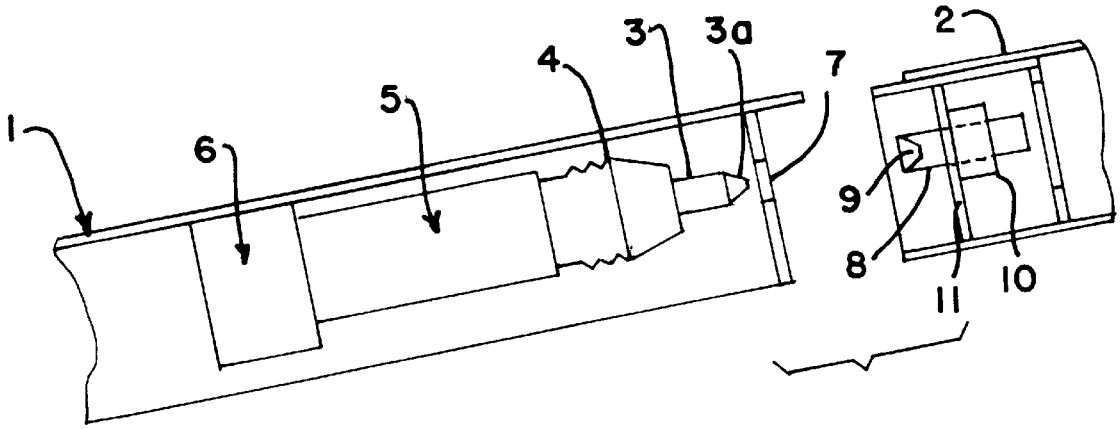
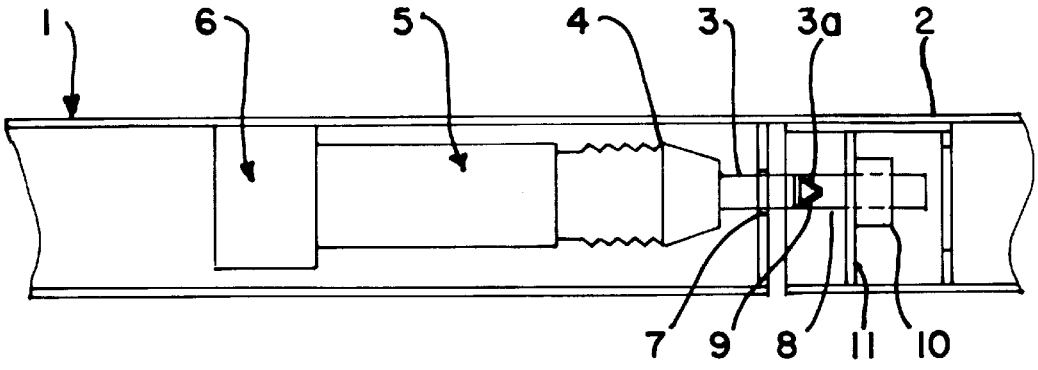
FIG. 2

IMPACT RESISTANT SAFETY DOOR LATCH MECHANISM

TECHNICAL FIELD

The present invention relates to door latch mechanisms. In particular, the present invention is directed to a safety door latch mechanism which maintains the door in a latched position even when subjected to impact applied both perpendicularly and in parallel to the door jamb.

BACKGROUND OF THE INVENTION

Door latching mechanisms, especially those used in automobile or other vehicles, typically required latch pins which project from a door post or jamb. These pins are held by a partially revolving clasping mechanism in a manner well known in this art. For the sake of easy operation, the clasping mechanism is easily and automatically rotated about the latch pin when the door is closed. This arrangement is very successful for normal opening and closing of the automobile doors. However, the relative positioning of the latch pin and the clasping mechanism is critical for the proper operation of such a system. Consequently, this arrangement becomes very unreliable when the vehicle is subjected to an impact that may force the door and the door jamb out of alignment. It is often quite common for doors to spring open when the vehicle is subject to impact because such impact often forcibly misaligns the door and the door jamb, or deforms the door causing the clasping mechanism to partially rotate and separate from the latch pin.

Also, conventional latch pins normally pick up grease or other lubricants used with the door clasping mechanism. Such lubricants can be transferred to the clothing or skin of occupants when entering or exiting the vehicle. Also, under some circumstances, the clasping mechanism, as well as the exposed latch pins, can become hazardous to the passengers. Further, the latch pins and the clasping mechanism, as well as the exterior handles used to operate them, are often considered unsightly and thus, not well suited for vehicles being displayed in shows.

Some of the aforementioned characteristics can lead to hazardous conditions. All remain undesirable despite the many efforts made in these conventional art to correct for the deficiencies.

SUMMARY OF THE INVENTION

It is a first object of the present invention to provide a security door latching mechanism mounted in the interior of the door and the interior of a complementary door jamb in order to keep the latching mechanism hidden and secure.

It is an additional object of the present invention to provide a vehicle door latching mechanism that is impact resistant so as to hold the vehicle door in it's closed position even when the vehicle is subjected to impact.

It is another object of the present invention to provide a hidden vehicle door latch mechanism that does not detract from the appearance of the vehicle when used for display purposes.

It is still another object of the present invention to provide a automobile door latching mechanism that can be directly and positively operated to latch and unlatch the vehicle door.

It is a further object of the present invention to provide a vehicle door latching mechanism that does not require extensive exposed lubricants.

It is yet an additional object of the present invention to provide a vehicle door latching mechanism that is amenable to electrical actuation for both latching and retracting.

It is yet another object of the present invention to provide vehicle door latching mechanism for which the operating latch mechanism is completely retracted and inaccessible when the vehicle door is in an open position, thereby eliminating any chance of human contact with the latching mechanism.

It is still a further object of the present invention to provide a security door latching mechanism that can operate in a "fail-safe" locked mode whenever certain predetermined conditions exist.

It is a further object of the present invention to provide a security door latching mechanism that resists binding of the locking shaft with the receiver.

These and other objects of the present invention are achieved though the use of a security door latching mechanism that includes a locking mechanism contained within the interior of a door and a complementary receiver contained within the interior of the complementary doorjamb. The latching mechanism includes a plunger shaft arranged to forcibly extend from the door into the receiver in the doorjamb when in an extended position. A power supply is to provide electrical power to the latching mechanism. An actuating device is used to forcibly maintain the plunger shaft in an extended position when power is not provided to the actuating device. Constant power is necessary for the actuating device to retract and hold the plunger shaft away from the receiver.

BRIEF DESCRIPTION OF THE DRAWINGS

FIG. 1 is a top view of a diagram depicting the latch mechanism in the retracted position (door open).

FIG. 2 is a top view of a cut away diagram depicting the latching mechanism in the extended position (door closed).

DESCRIPTION OF THE PREFERRED EMBODIMENTS

Figure 3:
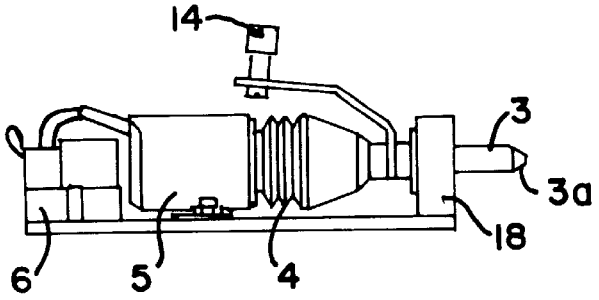
FIG. 3 is a side elevation view of the latching mechanism, depicting additional features of the present invention.

The novel features of the present invention may be best understood by reference to FIGS. 1, 2, 3 and 4 each of which includes the same elements that are labeled by the same designation numerals. When considered that the present invention is used with a conventional security door and doorjamb, the distinctions between the present invention depicted in FIGS. 1 and 2 and security door latching mechanisms of the conventional art become apparent.

A preferred embodiment of the present invention is used in an environment constituted by vehicle door 1 and door frame or jamb 2. Both the door and the jamb are of standard vehicle design which need little modification to easily accommodate the mechanism of the present invention as depicted in FIGS. 1 and 2. Such adjustments are easily within the capabilities of those skilled in the art of automotive fabrication and/or adjustment. As is apparent from these drawings, the latching mechanism of the present invention operates along the longitudinal axis of the door 1 and perpendicular to the door jamb 2.

A key feature of the present invention resides in the actuating mechanism 5, which extends plunger shaft 3 to receiver 8 (in door jamb 2) and retracts the plunger shaft away from the receiver to allow the door 1 to open. Normally, the actuators forcibly maintains the plunger shaft in the extended position with a spring or other well-known technique. In normal operation, the plunger shaft 3 is retracted (though aperture 7 in the door closure) by providing electrical power from power supply 6 to actuator 5. Retraction is normally carried out through the use of an electromagnetic or another equivalent mechanism contained in the door actuator. In order for the plunger shaft to remain in the retracted position, power has to be maintained through the actuator. Thus, any power loss to the power supply 6 will cause the plunger shaft to immediately move into the extended position.

Figure 4:
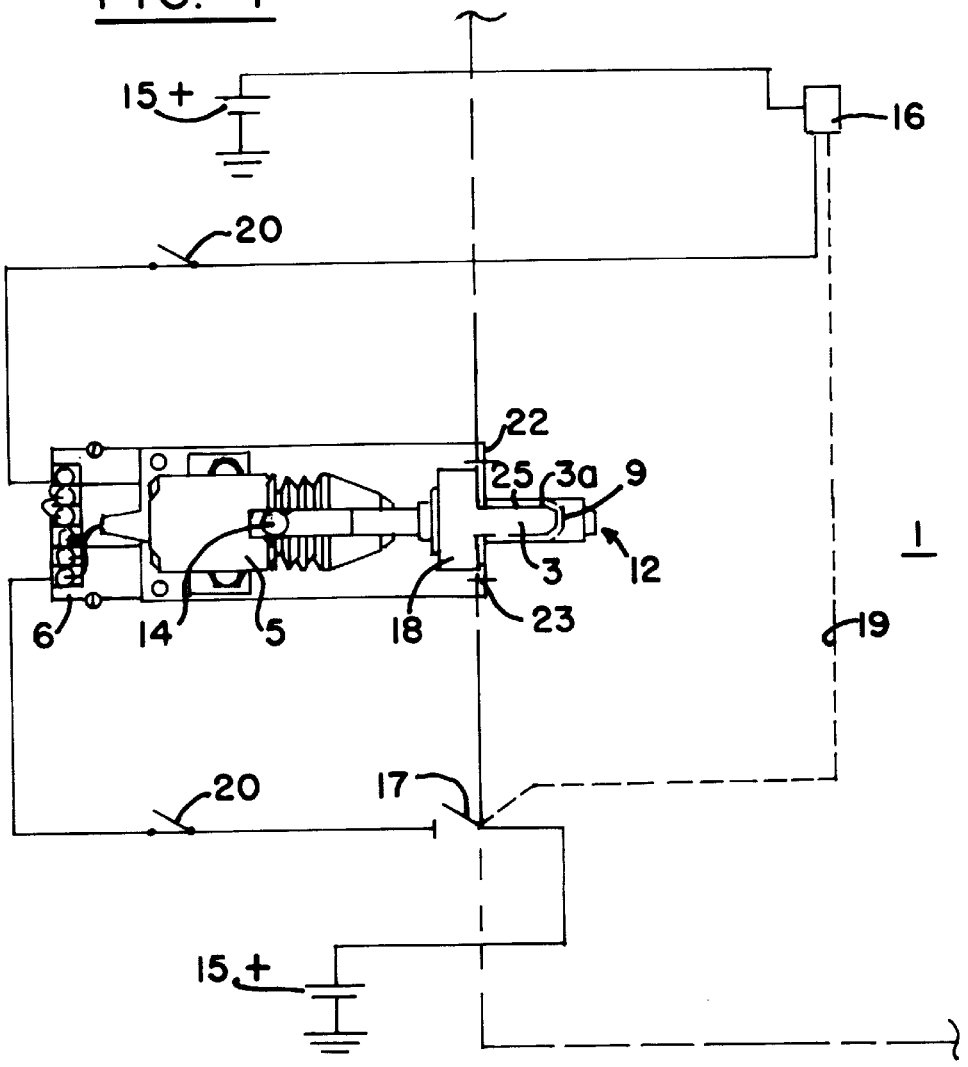
FIG. 4 is a top view of a different arrangement of the latching mechanisms and receiver, mounted in the door jamb and the door, respectively.

Another way of moving the plunger shaft 3 into the retracted position is through the use of a mechanical override lever 14 (as depicted in FIGS. 3 and 4). This is especially important when the present invention is mounted in a vehicle door which might be subject to an impact where electrical power is lost. Normally the mechanical override lever would be located inside the vehicle in order to maintain the smooth appearance of the vehicle side. However, multiple levers could be mounted so as to operable from either the interior of the vehicle or the exterior of the vehicle. Further, a lever operable from the exterior of the vehicle could be detachable and used only when necessary by placing one end of the lever into a slot (not shown) to access plunger shaft 3 to temporarily pull it into the retracted position.

Power supply 6 is necessary to provide the correct amount of power to operate the electromagnetic or any other device necessary to retract plunger shaft 3. The power supply can be controlled by a number of switches. For example, the latching switch 16 (in FIG. 4) is an electrical switch which normally latches into a closed position to maintain power to the power supply. The power source attached to the switch is preferably the car battery 15. However, other power sources can be used where appropriate.

Another method of controlling the operation of the actuator by provinding power to the power supply 6 is through the use of door switch 17. This element operates to cut off all electrical power to power supply 6 thereby releasing power shaft 3 into the extended position when the door to the vehicle closes. Thus, door switch 17 is normally opened when the door to the vehicle is closed and normally closed when the door to the vehicle is opened. Also, door switch 17 resets latching switch 16 so as to ensure that no power to this switch reaches the power supply unless switch 16 is activated once more by an operator. This operation is ensured through the use of linkage 19 which can be either electrical or mechanical. The key component of the operation is that the opening of door switch 17 also opens latching switch 16.

Additional safeguards can be built into the system through the use of fail safe switches 20 which are operated based upon the drive mode of the vehicle. For example, fail safe switches 20 remain open whenever the vehicle is in the drive or reverse mode so as to prevent power from reaching power supply 6 to retract plunger shaft 3. As a result, the plunger shaft remains securely within the receiver 8 and the door remains secure. Other protective and safety measures will be apparent to any practitioners already familiar with this art, and can be used with the present invention as described with respect to the fail safety switches and the door switch.

Other measures are available to operate latching switch 16. As previously discussed, this switch can be controlled from either the exterior or the interior of the vehicle, or both. Further, the switch can be controlled by way of radio frequency signals, or by infra-red signals in a manner that is well known for locking and unlocking vehicle doors. Also, an electronic key pad can be used to operate latching switch 16, as well as a mechanical key and lock.

The latching mechanism includes a protective boot 4 made of rubber or a similar flexible material arranged around plunger shaft 3, protecting it in both of the extended (FIG. 2) and withdrawn or retracted (FIG. 1) positions. The protective boot need only be flexible enough to accommodate the two positions of plunger shaft 3 and it's connection with actuating cylinder 5. This interface is critical since the mechanism that moves plunger shaft 3 is contained in actuating cylinder 5. Consequently, without the protection of boot 4, the interface between actuating cylinder 5 and plunger shaft 3 will be vulnerable to dirt or other contaminants that could degrade the mechanism which moves plunger shaft 3. The mechanism itself is a well known arrangement to one skilled in this art and need not be elaborated upon further for purposes of the present invention.

Whatever kind of control mechanism is used, the key operation of the present invention includes plunger shaft 3 extending through an aperture 7 in the door structure perpendicular to the longitudinal axis of the door and into recess 9 (preferably a conical concavity) in receiver 8 located in door jamb 2. The plunger shaft has a conical portion 3 (*a*) which is tightly received in recess 9 to ensure a secure bond between door 1 and jamb 2. Support structures 10, 11 hold receiver 8 in position within the door jamb 2.

Although a first embodiment has been described as arranging latching mechanism within a vehicle door and the receiver within the vehicle doorjamb, it is noted that the electrical wiring necessary for the present invention may be more easily installed if the latching mechanism is arranged within the doorjamb while the receiver is arranged within the door itself. FIG. 4 depicts this particular arrangement which is virtually the same as that of FIGS. 1 and 2. It is noted that for increased security, the mounting of the latching mechanism can be strengthened by mounting plate 18 (in FIG. 3) which is used to anchor the actuator firmly between the two major parallel walls to the door or the doorjamb. This also aids in effecting a relatively precise mounting between the touching mechanism and the receiver. This precision is highly desirable because a tight fit between the receiver 8 and the plunger shaft 3 provides for a more solid closure of the door within the door jamb.

This is further effected by the use of a conically-shaped distal end 3 (*a*) of plunger shaft 3. The conical portion is arranged to fit precisely within recess 9 which is shaped precisely as a conical concavity to accommodate the distal end. This interface is used to effect the tight fit between the latching mechanism and the receiver. On the other hand, the cylindrical space 25 which leads to recess 9 is fabricated with substantial tolerances to loosely accommodate plunger shaft 3 in order to avoid binding or jamming the plunger shaft in the receiver. For example, in a preferred embodiment the recess is 9/16 inch diameter while the plunger shaft is ½ inch in diameter. This provides a tolerance between these two elements of 12½% to prevent binding between the plunger shaft and the recess. This can be especially critical if the vehicle undergoes an impact that deforms the door and the door jamb.

In order to ensure precision of fit between distal end 3 (*a*) and recess 9, it is necessary that the receiver 8 be adjustable within either the door 1 or the door jamb 2. Adjustments perpendicular to the plunger shaft 3 are carried out by adjusting mounting plate 22 using bolts 23. Preferably, the receiver 8 is formed as a solid piece with mounting plate 22 so that adjustment either vertically or horizontally (perpendicular to the longitudinal axis of plunger shaft 3) will allow precise alignment along a single longitudinal line for both plunger shaft 3 and receiver 8. Distance between recess 9 and distal end 3 (*a*) is adjusted by adjusting screw 12 which moves the recess 9 along the axis of plunger shaft 3.

FIGS. 3 and 4 depict typical dimensions for an embodiment of the present invention to be mounted in a vehicle door. However, a larger version of the present invention can be used for larger vehicles just as smaller versions of the present invention can be used for smaller vehicles. Further, the present invention is not limited to vehicles. Rather, the latching mechanism of the present invention can be placed within the door of any structure having sufficient thickness to accommodate such a mechanism. It is presumed that such structures will be steel security doors. However, hollow wooden doors, or wooden doors with hollowed out portions can accommodate the mechanism of the present invention. The same type of door switch (17 in FIG. 4) can be used to deactivate the electrical system and forcibly send plunger shaft 3 into the extended position as soon as a door to a building closes just as described for the door to a vehicle. All the accommodations described with respect to vehicle doors can be applied to security doors for fixed structures when using the present invention.

Although preferred embodiments have been described by way of example, the present invention should not be construed as being limited thereby. Consequently, the present invention should be considered to include any and all equivalence, modifications, variations and other embodiments limited only by the scope of the appended claims.

I claim:

1. A latching mechanism and complementary receiver contained within the interior of a door and a complementary door jamb, said latching mechanism comprising:

a. an elongated plunger shaft having a cylindrical body and a substantially conical distal end arranged to extend from said door into said receiver in said door jamb when said plunger shaft is in an extended position, said receiver having a cylindrical concavity terminating in a substantially conical concavity, said plunger shaft and said cylindrical and substantially conical concavities being respectively configured so that said substantially conical distal end of said plunger shaft fits tightly into said substantially conical concavity while said cylindrical body of said plunger shaft fits loosely in said cylindrical concavity so that a diameter of said cylindrical body of said plunger shaft and a diameter of said cylindrical concavity have a predetermined size difference;

b. a power supply arranged to provide electrical power to said latching mechanism; and, c. actuating means for forcibly maintaining said plunger shaft in an extended position, and for retracting said plunger shaft away from said receiver only when said actuating means is provided with electrical power.

2. The apparatus of claim 1, wherein said door is that of an automotive vehicle.

3. The apparatus of claim 2, further comprising:

(d) a boot arranged to cover an intersection where said plunger shaft enters said actuating means.

4. The apparatus of claim 3, wherein said actuating means comprise an electromagnet and at least one spring.

5. The apparatus of claim 3, further comprising:

(e) a latching switch arranged for providing electrical power to retract said plunger shaft, said latching switch arranged to remain in a closed position until reset.

6. The apparatus of claim 5, further comprising:

(f) a manual lever arranged to pull said plunger shaft to a retracted position away from said receiver, said manual lever extending through said door.

7. The apparatus of claim 6, further comprising:

(g) a door switch arranged to cut off power to said power supply and to latch said latch switch in an open position when said door is closed.

8. The apparatus of claim 7, further comprising:

(h) at least one operational cut off switch to prohibit all power to said power supply when said vehicle is in the drive or reverse modes of operation.

9. The apparatus of claim 1, wherein said plunger shaft has an approximately cone-shaped distal end that enters said receiver.

10. The apparatus of claim 9, wherein said diameter of said plunger shaft and said diameter of said cylindrical concavity are configured to have a substantially 12½% tolerance between them.

11. The apparatus of claim 10, wherein said receiver comprises first adjusting means for moving said receiver along a longitudinal axis of said plunger shaft.

12. The apparatus of claim 11, wherein said receiver further comprises a second adjusting means for moving said receiver in directions perpendicular to said longitudinal axis of said plunger shaft.

13. The apparatus of claim 5, wherein said latching switch is responsive to radio frequency signals.

14. The apparatus of claim 5, wherein said latching switch is responsive to infrared-signals.

15. The apparatus of claim 5, wherein said latching switch is operable by a mechanical key.

16. The apparatus of claim 5, wherein said latching switch is operable by an electronic key pad.

17. A latching mechanism and complementary receiver contained within the interior of a door and a complementary doorjamb, said latching mechanism comprising:

a. an elongated plunger shaft having a cylindrical body and a substantially conical distal end arranged to extend from said door into said receiver in said doorjamb when said plunger shaft is in an extended position, said receiver having a cylindrical concavity terminating in a substantially conical concavity, said plunger shaft and said cylindrical and substantially conical concavities being respectively configured so that said substantially conical distal end of said plunger shaft fits tightly into said substantially conical concavity while said cylindrical body of said plunger shaft fits loosely in said cylindrical concavity so that a diameter of said cylindrical body of said plunger shaft and a diameter of said cylindrical concavity have a predetermined size difference;

b. a power supply arranged to provide electrical power to said latching mechanism; and, c. actuating means for forcibly maintaining said plunger shaft in an extended position, and for retracting said plunger shaft away from said receiver only when said actuating means is provided with electrical power.

* * * * *